US007789970B2

(12) United States Patent
Rosin

(10) Patent No.: US 7,789,970 B2
(45) Date of Patent: Sep. 7, 2010

(54) METHODS AND SYSTEMS FOR CLEANING HEAT-EXCHANGE SURFACES OF A HEAT EXCHANGE SYSTEM

(75) Inventor: Tomas Rosin, Turku (FI)

(73) Assignee: Foster Wheeler North America Corp., Clinton, NJ (US)

( * ) Notice: Subject to any disclaimer, the term of this patent is extended or adjusted under 35 U.S.C. 154(b) by 679 days.

(21) Appl. No.: 10/549,280

(22) PCT Filed: Mar. 31, 2004

(86) PCT No.: PCT/FI2004/000190

§ 371 (c)(1),
(2), (4) Date: Sep. 13, 2005

(87) PCT Pub. No.: WO2004/088235

PCT Pub. Date: Oct. 14, 2004

(65) Prior Publication Data

US 2006/0169304 A1 Aug. 3, 2006

Related U.S. Application Data

(60) Provisional application No. 60/458,442, filed on Mar. 31, 2003.

(51) Int. Cl.
*B08B 9/00* (2006.01)

(52) U.S. Cl. ..... 134/22.1; 134/22.11; 134/22.12; 134/22.18

(58) Field of Classification Search ..... 134/6, 134/8, 18, 22.1, 22.11, 22.12, 22.18, 24, 134/37, 56 R, 58 R, 166 C
See application file for complete search history.

(56) References Cited

U.S. PATENT DOCUMENTS 4,466,383 A * 8/1984 Klatt et al. ..... 122/379
4,617,988 A 10/1986 Köhnen et al.
4,718,376 A 1/1988 Leroueil et al.
4,814,868 A * 3/1989 James ..... 348/83
4,864,972 A * 9/1989 Batey et al. ..... 122/448.3

(Continued)

FOREIGN PATENT DOCUMENTS

WO WO 03/006185 1/2003

OTHER PUBLICATIONS

International Search Report.

(Continued)

*Primary Examiner*—Michael Kornakov
*Assistant Examiner*—Eric Golightly
(74) *Attorney, Agent, or Firm*—Nixon & Vanderhye P.C.

(57) ABSTRACT

Means for obtaining accurate knowledge of location and amount of fouling inside a heat exchange system, such as a boiler of a power plant, are provided. According to the invention this knowledge can be used to optimize cleaning of a heat exchange system. The system of the invention comprises: Means for measuring particles in the exhaust gas stream of the heat exchange system. These particles are at least partly released when cleaning a certain part of the heat exchange surface of the heat exchange system. Means for creating information of the fouling in an electronic memory by linking together coordinates of the part of the heat exchange surface being cleaned and the measurement data created during the cleaning of said part.

16 Claims, 5 Drawing Sheets

U.S. PATENT DOCUMENTS 4,996,951 A * 3/1991 Archer et al. ..... 122/379
5,591,895 A * 1/1997 Rigby ..... 73/28.01
5,658,361 A 8/1997 Arencibia, Jr.
5,873,408 A 2/1999 Bellet et al.
6,325,025 B1 * 12/2001 Perrone ..... 122/379
2002/0007772 A1 1/2002 Janssen et al.

OTHER PUBLICATIONS

Examination Report, EPO, Mar. 19, 2010.

* cited by examiner where: $T_k$ = time elapsed between the last run of cleaning unit k
$m_k$ = particle mass flow when cleaner k is running

METHODS AND SYSTEMS FOR CLEANING HEAT-EXCHANGE SURFACES OF A HEAT EXCHANGE SYSTEM

This application is the US national phase of international application PCT/FI2004/000190 filed 31 Mar. 2004 which designated the U.S. and claims benefit of U.S. 60/458,442, dated 31 Mar. 2003, the entire content of which is hereby incorporated by reference.

FIELD OF THE INVENTION

The present invention relates generally to process industry, such as power plants. Particularly the present invention relates to determining fouling in a heat exchange system and method of cleaning such a heat exchange system, such as a boiler of a power plant. More particularly, the present invention relates to a method for air/fuel control. Furthermore the present invention relates to a method for optimizing of cleaning particles or fouling from surfaces of a process system.

BACKGROUND OF THE INVENTION

It has been known for a long time that maintaining the stoichiometric ratio between air and fuel in a pulverized fuel fired process is an important criterion to minimize emissions such as $NO_x$ and CO. For example, a pulverized coal (PC) boiler constitutes a large number of burners. It has been both observed and proved that the stoichiometric ratio between air and fuel has to be maintained on a per burner basis. Therefore, both the fuel flow and the airflow are measured, and either the airflow or the fuel flow is used as the control variable, to keep the ratio between the fuel flow and the airflow for each individual burner within strict limits.

It has been proved that matching the airflow to the fuel flow for each individual burner reduces emissions as well as improves other variables in the operation of a solid fuel fired boiler. However, it has been identified that only matching the airflow and the fuel flow does not provide the minimum emission level for the $NO_x$, CO and other adjacent emissions.

The typical and current air/fuel balancing concept has been described in the scheme of FIG. 1. As illustrated in FIG. 1, typical air/fuel balancing method is based on air flow and coal flow measurements for each individual burner. Please note, that the total amount of air is matched with the total amount of fuel by keeping the $O_2$ concentration in the exhaust gas on a certain level (e.g. 2%). The point of the known optimization methods is to keep the same share of fuel and air on each burner. If one burner carries a higher amount of fuel, a higher amount of air should be distributed to that burner. That is, the percent fuel and the percent air on one burner should be the same. However, now it has been surprisingly observed that occasionally either more or less air than the stoichiometric ratio would suggest, is needed for a certain burner in order to minimize the emissions. The reason for this phenomenon is unknown, but has most likely a connection to the mixing properties of the fuel and air in the flame. Therefore, a need exists in the industry for a method of optimizing air/fuel ratio wherein optimization will be made more efficiently being based on the measurements of the actual process conditions.

The present invention relates further to soot cleaning optimization. Minimizing of emissions such as NOx, decreases also the need for soothing. Cleaning particles (fouling) from surfaces is a routine that is fairly common in the process industry. For example, when running a combustion process it is essential to keep heat exchanger surfaces clean for the sake of efficiency. Many different kinds of soot cleaners (blowers) are used and they are run according to a certain sequence to keep the heat exchange surfaces as clean as possible. The soot cleaning is generally done by blowing steam on the heat transfer surfaces or by using pressurized air or sound waves to remove the particle layer, mainly soot from the heat transfer surfaces. The particles released from the heat transfer surface section that is soot blown are then entrained into the exhaust gas stream.

Running soot cleaners is expensive. Furthermore, cleaning heat exchanger tubes with steam, without any particle layer on their surfaces, is very eroding for the walls of these tubes. Erosion of the heat exchanger tubes is again a very expensive affair. However, high expenses will emerge as well if soot cleaners are not used at all. Therefore, it is of great importance to optimize the soot cleaning process thoroughly.

Typically the need for the soot cleaning is estimated from raised exhaust gas temperatures and possible steam temperature anomalies. Some systems weight the heat transfer tubes and on the basis of the mass of the tubes estimate the amount of the fouling on the tubes. Information obtained by these methods does not necessarily give the precise information about which heat exchanger tubes has the most part of the soot stuck to its surface and which tubes are fairly clean.

Therefore, a need exists in the industry for a method of optimizing soot cleaning whereby the soot cleaning will be made more economically and efficiently being based on the measurements of the actual process conditions.

OBJECTS AND SUMMARY OF THE INVENTION

It is an object of the invention is to provide a method for air/fuel control wherein at least one of the group of primary airflow, mill parameters, and secondary airflow is controlled using a control algorithm, which is determined by correlation analysis between ECT signals and the output and input signals of the process in order to detect dependencies, and by fuzzy modeling of the dependencies.

Furthermore, an another object of the invention is to provide a soot cleaning optimization method to be used in a process industry in which information on a sequence of a cleaning, time between running, etc. variables for cleaning devices are optimized based on the measurement of the particles entrained in the gas stream of the process. The measurement is based on detecting static electricity and/or change thereof in the gas stream of the process.

Another object of the invention is to provide means for obtaining accurate knowledge of location and amount of fouling inside a heat exchange system, such as a boiler of a power plant. According to the invention this knowledge can be used to optimize cleaning of a heat exchange system.

A typical method in a heat exchange system according to the invention comprises following steps:

Exhaust gas steam is led by a heat exchange surface of the heat exchange system.

A certain part of the heat exchange surface of the heat exchange system is cleaned with a cleaning equipment having an operation parameter status. A typical cleaning equipment of the invention, e.g. a steam based soot blower in a boiler, is arranged to clean a certain part of the heat exchange tubes in the boiler. A typical large boiler comprises several separate pieces of cleaning equipment, each of which can typically be run separately of each other. A typical steam based soot blower in a boiler blows steam of a certain pressure on the heat exchange tubes to be cleaned and is moved over its part of the tubes at a certain point of time, with a certain speed. These operation parameters can normally adjusted by the operator of the boiler.

Particles are released from the heat exchange surface. Normally and mostly these particles are soot. Soot is formed on different parts of the heat exchange surfaces with different speeds depending on various process parameters, e.g. the type and amount of fuel used. The amount of particles released from a certain part of the heat exchange surfaces by the cleaning equipment depends e.g. on the steam pressure of the cleaning equipment and the amount of particles that has been formed on that certain part being cleaned. The time elapsed between two cleanings of the same heat exchange tubes naturally effects on the amount of impurities formed on the tubes.

The released particles are led into the exhaust gas stream of the heat exchange system.

Amount and/or type of the released particles in the exhaust gas stream is measured and particle measurement data of these particles is created on the basis of these measurements. These measurements can be done with different kinds of equipment. Examples of a measurement systems and methods suitable for this purpose are given in the applicant's earlier patent publications U.S. Pat. No. 6,031,378 and WO 02/06775. That system is called Electric Charge Transfer System, or ECT-system. Suitable parts of these publications are hereby incorporated in this text by reference. In one embodiment of the invention the mass flow of particles in the exhaust gas stream is measured.

Information of the fouling is created in an electronic memory by linking together and storing in the electronic memory coordinates of the part of the heat exchange surface of the heat exchange system being cleaned and the measurement data created during the cleaning of said part.

A typical system for determining fouling in a heat exchange system according to the invention comprises means that enable the method of the invention, i.e.:

Means for detecting operation parameter status of a cleaning equipment arranged to clean a certain part of the heat exchange surface of the heat exchange system. Naturally, these means should provide the system with the status of the wanted operation parameters in electronic form.

Means for measuring the amount and/or type of released particles in the exhaust gas stream of the heat exchange system, e.g. the above-mentioned Electric Charge Transfer System, or ECT-system.

Means for creating particle measurement data of released particles in the exhaust gas stream. This is normally a runnable computer program on e.g. the memory of a PC or any other suitable computer.

An electronic memory e.g. on the PC.

Means for creating information of the fouling in the electronic memory by linking together and storing in the electronic memory coordinates of the part of the heat exchange surface of the heat exchange system being cleaned and the measurement data created during the cleaning of said part. This means that a database is created e.g. on the hard disc of the PC. This database can then be used in many different ways to examine the fouling.

The system of the invention can comprise e.g.:

Electronic means for analyzing the information of the fouling and for creating control signal for the cleaning equipment of the heat exchange system. This means e.g. a computer program used to analyze the information of the fouling in the electronic memory and signaling means from said computer to the cleaning equipment.

The operation parameter status of the cleaning equipment that is detected and stored in the electronic memory typically comprises status of at least one and preferably several of the following operation parameters:

Identification data of the cleaning equipment. The piece of cleaning equipment used at any time should be clearly identifiable.

Coordinates of the cleaning equipment in the heat exchange system.

Operational status of the cleaning equipment, i.e. is the cleaning equipment running or not running, Speed of the cleaning equipment.

Information on the effect of the cleaning equipment, e.g. steam pressure used.

The most important piece of information to know is from which part of the heat exchange surfaces the particles measured in the exhaust gas stream were released. Knowledge about fouling tendency, i.e. the amount of fouling formed on different parts of the heat exchange system is obtained with this information. Typical suitable soot blower equipment comprises at least one of the following types of devices:

steam based soot blower acoustic soot blower air gun.

Other possible cleaning equipment suitable for use in the method and system of the invention are:

hammer cleaner mechanical cleaner, such as steel-wire brush.

These different kinds of cleaning equipment are suitable for different circumstances.

In an embodiment of the method according to the invention the information of the fouling stored in the electronic memory is processed as a function of the heat exchange surface coordinates. Typically his process comprises optimization steps in order to find at least one of the following optimal parameters:

an optimal time to start cleaning of a particular part of the heat exchange surface of the heat exchange system optimal cleaning speed for a cleaning equipment of a particular part of the heat exchange surface of the heat exchange system optimal operation parameters for the cleaning equipment for cleaning a particular part of the heat exchange surface of the heat exchange system.

In an embodiment of the invention the aforementioned optimization is based on one or more of the variables:

time to be elapsed between two cleanings of a particular part of the heat exchange surface of the heat exchange system fouling tendency of ash on a particular part of the heat exchange surface carbon content in ash.

As a result of this kind of optimizations more efficient cleaning of the heat exchange system is achieved.

In further embodiments of the invention the information of the fouling stored in the electronic memory is used for at least one of the following:

Estimating fouling tendency on the heat exchange surfaces as a function of heat exchange surface coordinates. This means information about how easily fouling is formed on a certain location on the heat exchange surfaces.

Estimating fouling distribution on the heat exchange surfaces as a function of heat exchange surface coordinates. This means information about how much fouling is there on a certain location on the heat exchange surfaces.

As a result of this kind of estimations cleaning of the heat exchange system can be planned to be more efficient.

In an embodiment of the invention particle distribution on a cross-section of the exhaust gas channel is measured the measured data of the particle distribution is compared on previous measurements of the particle distribution fouling tendency and location for the fouling in the heat exchange system is determined by utilizing the comparison.

The particle distribution on a cross-section of the exhaust gas channel gives knowledge, when compared with previous results, about the origin of the particles. The afore-mentioned Electric Charge Transfer measurement system is very suitable for these particle distribution measurements. With help of the ECT system fouling tendency and location for the fouling in the heat exchange system are determined in an accurate manner. Also the amount of unburned carbon in the ash flow in the exhaust gas stream can be estimated using signals produced by the ECT measurement system.

BRIEF DESCRIPTION OF THE DRAWINGS

The present invention is illustrated by way of an example and is not limited in the accompanying figures, in which alike references indicate similar elements, and in which.

DESCRIPTION OF THE PREFERRED EMBODIMENTS

Generally, the first aspect of the invention provides a method for air/fuel control in burners, such as pulverized coal boiler, based on a measurement of a flow of particles for a suspension of gas and solids. The measurement can be used e.g. by using the measurement system disclosed in the applicant's earlier patent publication U.S. Pat. No. 6,031,378 and/or the method disclosed in the applicant's earlier patent publication WO 02/06775. The measurement system (Electric Charge Transfer System, ECT-system), disclosed in the above-mentioned patent publications, is able to measure e.g. the velocity and the mass flow of particles for a suspension of gas and solids. The ECT measurement is of a local character, that is, the signal caused by the flowing particles is a function of distance from the particles to the ECT antenna. Therefore, a big duct normally requires use of many ECT antennas. It should be noticed that the particles entrained in the gas flow are not necessarily evenly distributed over the whole duct. Using several antennas will ensure that the particle flow is sensed properly over the whole duct, even though the rope of the particles would change its coordinates. Please note that a not even distribution of ash particles in the exhaust duct contains also a lot of valuable information.

The ECT system measures the state of the two-phase flow in burner ducts. The ECT measurement splits the raw signal (ECT LF signal) into AC and DC components. DC component is the spectral line for ~0 Hz (mean value). Normal AC is the standard deviation of the raw signal on the frequency band 0.3-15 Hz. The ECT velocity measurement collects measurement signals with a high sampling frequency (22 kHz). Fans and compressors as well as the combustion process (flame) cause pressure gradients in the gas flow. These gradients can be seen as intensified spectral density on different frequencies on the raw signal (ECT HF signal).

It has been observed that some patterns in the above mentioned ECT signals correlate with the readings from the emission metering devices of the boiler. The ECT measurement will provide information whether more or less air is needed than the stoichiometric ratio between fuel and air would suggest. The methodology to determine the optimal dosing of air for a burner is explained in more detail below.

The ECT signals (HF and LF) mirror the flow properties in the burner ducts. These flow properties depend on the process variables such as particle size, mass flow, particle velocity, and the flame properties (flame properties affect mainly the ECT HF signals). Dependency between the ECT signals and the output signals (NOx, CO, O2, airflow measurements, etc.) is estimated with different methods. The following methods can be used: correlation analysis, spectral analysis and fuzzy modeling. The result will be a dependency matrix showing which burner(s) has the strongest connection to the emission rates (e.g. NOx and CO).

Figure 1:
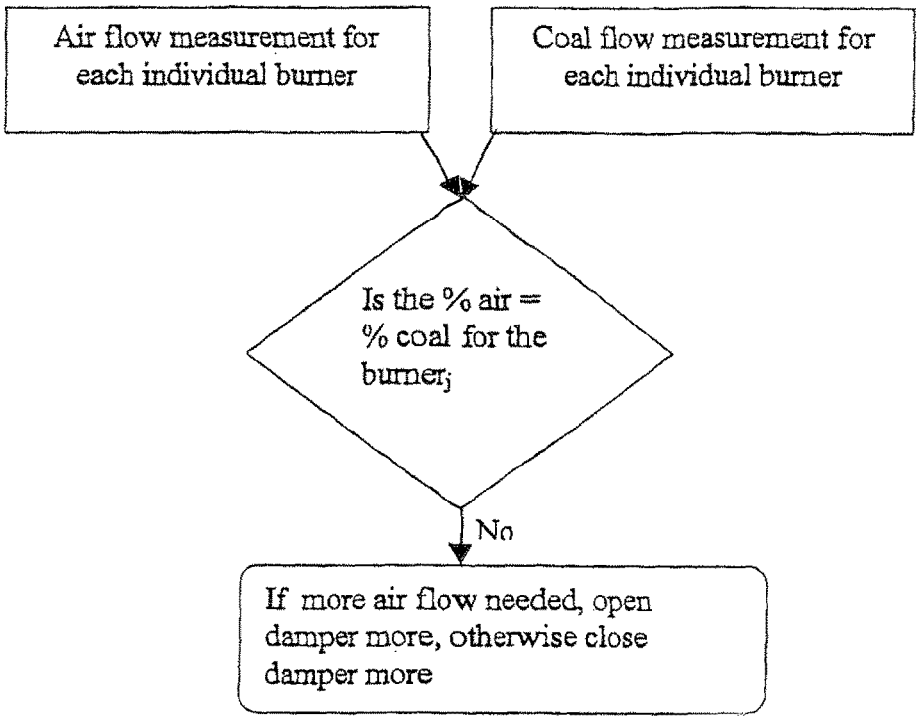
Fig. 1 (PRIOR ART)
FIG. 1 illustrates schematically an air/fuel balancing concept according to the prior art.
Figure 2:
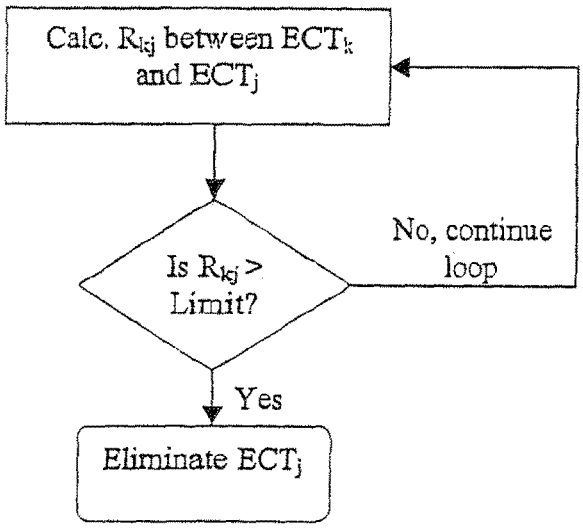
FIG. 2 illustrates schematically a flow scheme of correlation analysis according to the present invention.

The correlation analysis will typically build up large correlation matrixes between the ECT variables for the different burners as well as between the ECT variables of burners and the output variables (NOx, CO, O2, etc.). The size of the matrixes can be reduced significantly by eliminating such ECT signals that have strong correlation to a chosen ECT signal. In order to reduce the size of the matrix, a loop between 1 and n (number of burner pipes) is established where j expresses the reference burner pipe and k is the burner pipe against which the correlation is checked. If the correlation is strong enough between the ECT signals of the pipe j and the pipe k, the pipe k can be eliminated from the matrix due to the fact that the ECT signals for the pipe k is represented in the ECT signals in the pipe j because of the strong correlation. This method will reduce the size of the matrixes and would also make it possible to group different burner pipes according to their internal correlation. Please see the flow scheme illustrated in FIG. 2 (R shows the correlation).

Spectral analysis is applicable only on signals that have a well-defined sampling rate. This is not the case for many of the output measurements used in prior art methods, which are based on the principle of taking a sample and analyzing it offline. Also time of update for these measurements can be even a few minutes.

The most potential signal for spectral analysis purposes is the ECT HF signal for each pipe because this signal type reflects well the state of the flame. Please note that two individual channels are used for each pipe to get the particle velocity. The flame impacts the ECT HF signals strongly besides the fans that transport the gas into the boiler as well as out from the boiler.

The spectral analysis will divide the ECT HF signals into different bands and determine which of the bands are correlating with the flame quality, and which of the bands are also related to other variables such as particle size, mass flow of the coal etc. The standard deviation will be calculated for each band and stored as a variable in a matrix.

Figure 3:
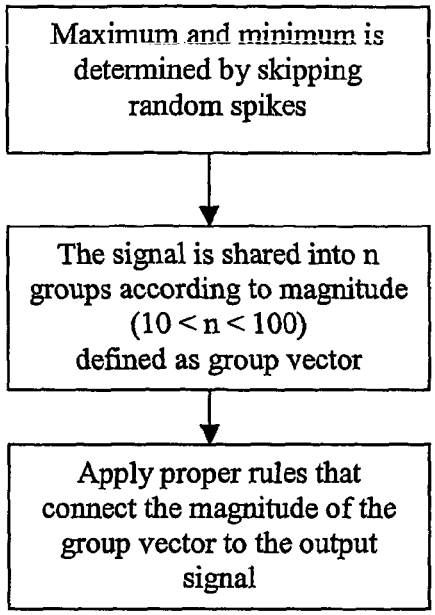
FIG. 3 illustrates schematically a fuzzy modeling algorithm according to the present invention.

When the ECT-system is used, there are a lot of signals available with different properties. The key issue is to be able to determine the dependency between these signals in a reliable and simple way. Fuzzy logic rules fulfill these criteria. The noise has to be removed from the signal without loosing any relevant information in the signal. The algorithm works roughly as illustrated in FIG. 3 for each measurement vector.

The air/fuel control method according to the present invention can favorably be added on top of the air to fuel balancing in order to gain more reduction in the emissions. The control variables that can be used are fairly limited. The main control variables to affect the process are as follows: primary airflow (PA), mill parameters (separator settings, etc.) and secondary airflow (SA).

Please note that the role of the primary airflow is to transport the coal to the furnace, and the primary air should usually be kept as low as possible. Therefore, this variable does not usually offer much controllability, but the primary air should be high enough to provide a proper transport of the coal.

Mill parameters such as separator settings etc. are important in order to keep the particle size of the coal as small as possible and the flow as steady as possible. However, there are only static classifiers (separators) on many plants, which limits the use of the separator settings as a control variable. It should be noticed that the steady flow of the fuel and a small particle size are essential for an optimal combustion.

Figure 4:
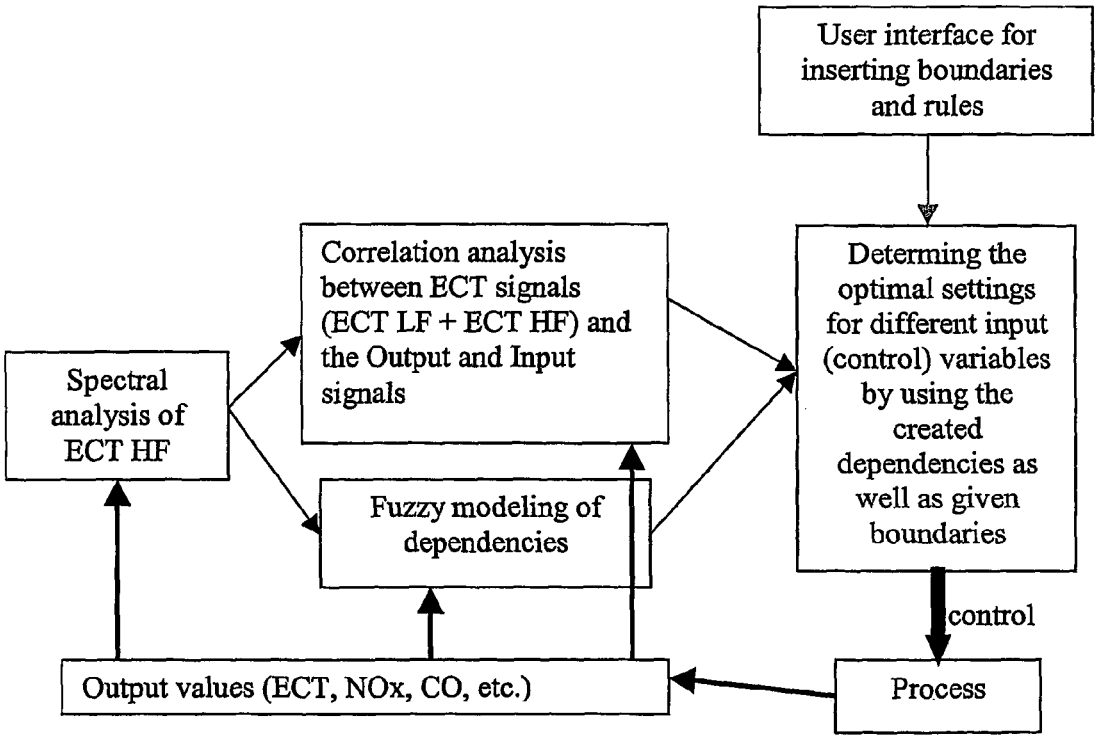
FIG. 4 illustrates schematically an implementation of a control system according to the present invention.

The most favorable variable to be used for minimizing the emissions is usually the secondary air (SA). The SA has a great impact on the flame, and hence, also impacts the ECT HF signals strongly. The block scheme as illustrated in FIG. 4 shows the control structure roughly.

Figure 7:
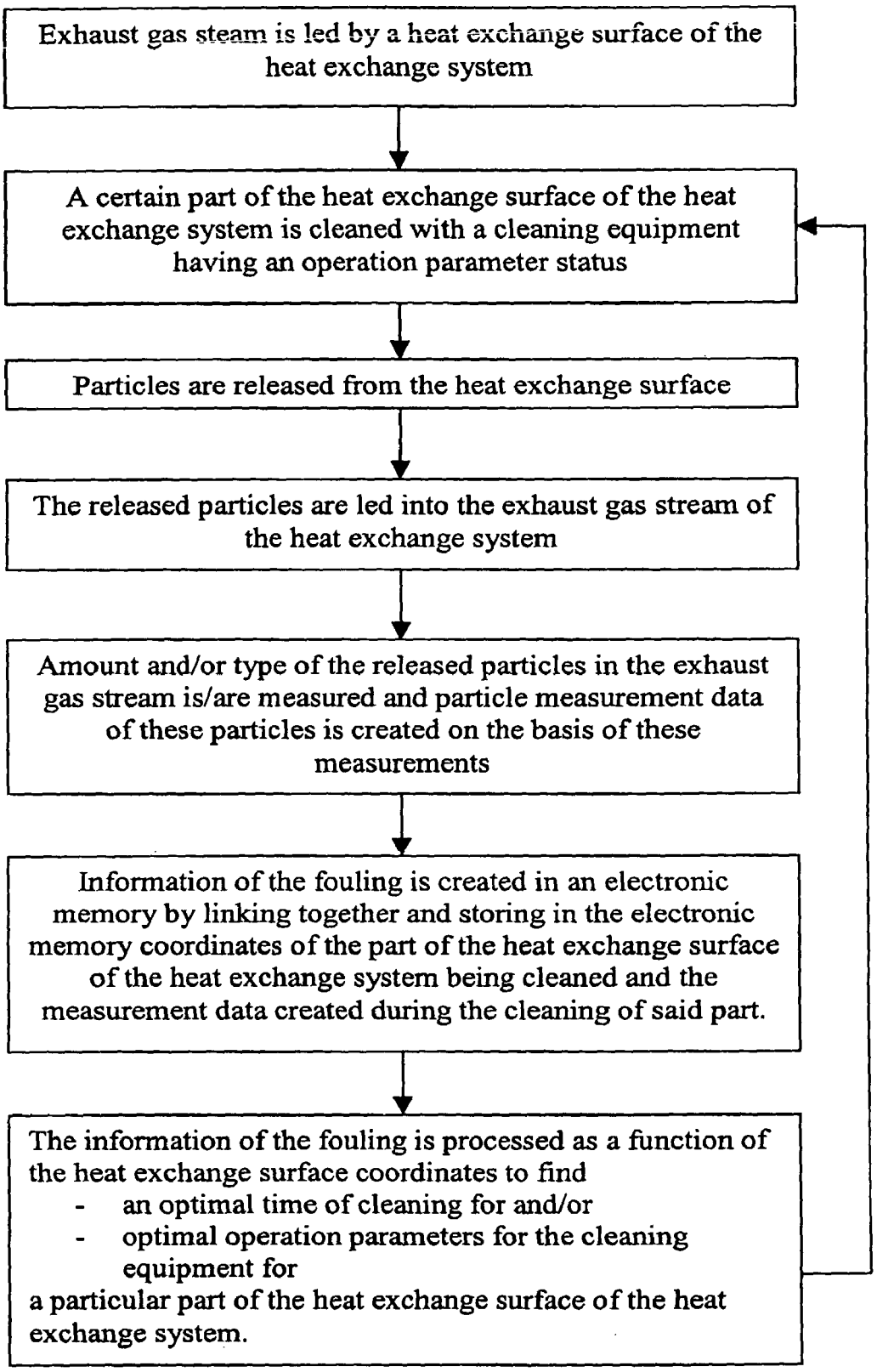
FIG. 7 illustrates a simplified block scheme of a soot cleaning method according to the present invention.

Generally, the second aspect of the present invention provides an optimized soot cleaning process based on a measurement of a mass flow of particles for a suspension of gas and solids. One process of this kind is illustrated as a simplified block scheme in FIG. 7. The measurement can be used e.g. by using the measurement system disclosed in the applicant's earlier patent publication U.S. Pat. No. 6,031,378 and/or the method disclosed in the applicant's earlier patent publication WO 02/06775. Other suitable measuring systems are for e.g. other electrical measuring systems and optical analyzing systems. The soot cleaning optimization method can be utilized also independently in processes in which method for air/fuel control according to the first aspect of the invention is not used.

Figure 5:
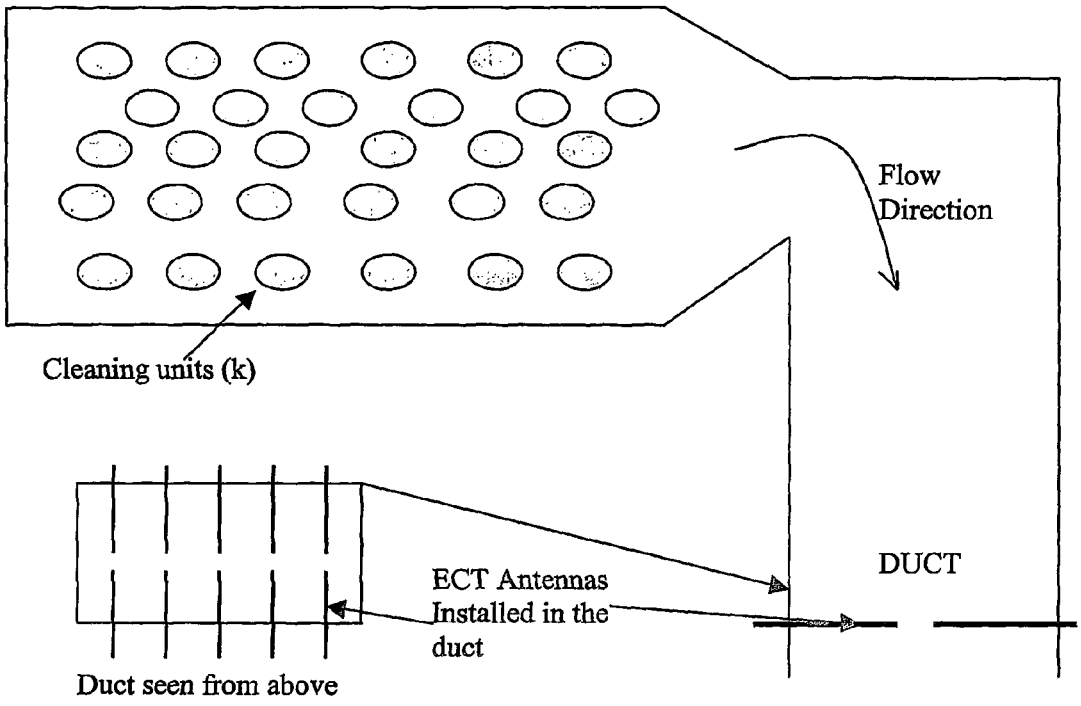
FIG. 5 illustrates a schematic embodiment of an arrangement according to the present invention.

When the soot cleaning (particle cleaning) is in operation there will be more particles entrained in the gas stream than normally. The increase in the concentration of the particles will be calculated based on the increase in the ECT reading during the soot cleaning. Please see the illustration in FIG. 5 describing the arrangement. It should be noted, that the soot cleaning method according to the present invention can be carried out by using also other suitable measuring systems than ECT and which can detect changes in the gas stream during the soot cleaning. Such systems include e.g. optical measuring systems and other electrical measuring systems, such as systems using laser or acoustic waves.

The dependency between each cleaner and the ECT reading is mapped. This means in practice that the amount of particles that has built up in the coverage of a cleaning device k is calculated from the ECT readings.

$$m_k = f(ECT)/T_k \quad (1)$$

where:

$m_k$=particle mass flow when cleaner k is running $T_k$=time elapsed between the last run of cleaning unit k It should be noticed that the signals from advantageously all ECT antennas will be used for calculating the mass of particles that are emerged into the gas stream by cleaning unit k. In a situation where several cleaners are running simultaneously, a multivariable correlation analysis is to be applied.

The main variable that is to be optimized is the time ($T_k$) between the run of each cleaning device k (k=1, n, where n is the number of cleaning devices). This procedure is fairly straightforward. A limit ($M_{LK}$) for how big the $m_k$ is to be for cleaning is defined. The $T_k$ is then extrapolated from the latest run of the cleaning unit k, by also noting other process variables such as gas flows, solid feeds, etc.

Besides the elapsed time between the run of the cleaning unit, also the runtime and other parameters concerning the cleaning device is to be determined in order to achieve a maximal cleaning efficiency. The object function for each cleaning device depends on the physical properties of the device and should, hence, be determined on a case by case basis.

Furthermore, it has been observed that a certain signal behavior reflects specific conditions for the particles passing the antenna matrix. For example a positive DC signal on a normal AC level indicates a higher content of carbon in the ash flowing past the ECT antenna matrix. If the particles show a high negative DC signal on a normal AC level, the particles possesses properties that enable them to easily to stick onto the surfaces. Hence, ECT signal can be used to estimate important properties for the ash flowing in the exhaust gas channel. Please note that a high carbon in ash indicates a poor combustion and hence a risk for fouling.

Figure 6:
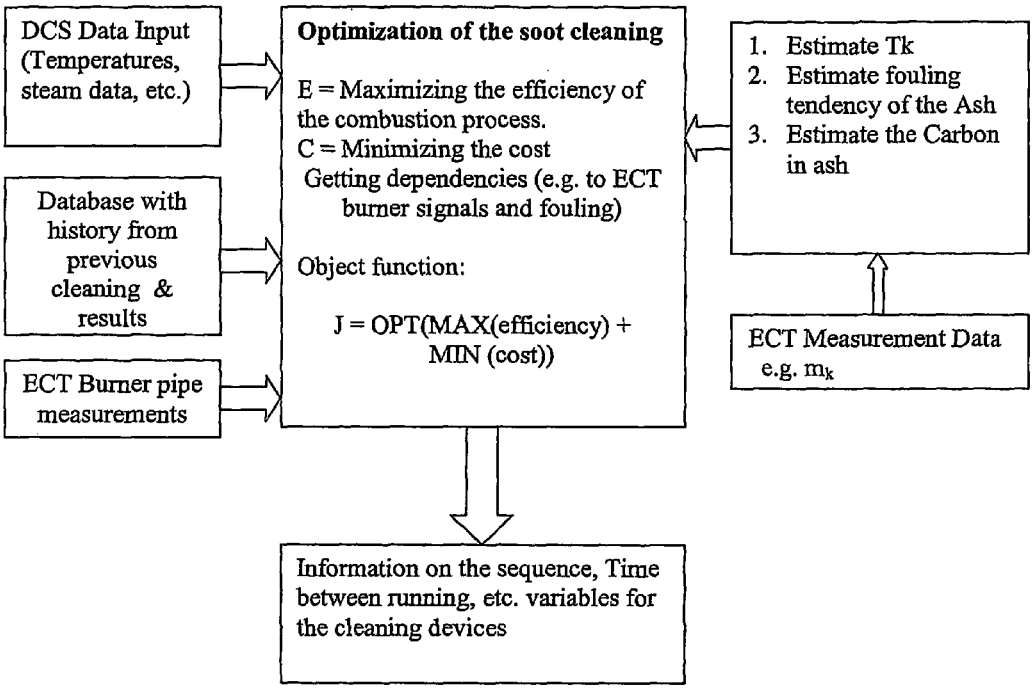
FIG. 6 illustrates a block scheme of an optimization according to the present invention.

The concept according to the present invention is used to optimize the soot cleaning more thoroughly. The block scheme in FIG. 6 illustrates the procedure. At least partly based on ECT measurements, one can estimate one or more of the following variables: 1) a time to be elapsed between runs of cleaning units k, 2) fouling tendency of the ash, and 3) carbon content in ash. Beside said estimates, one can use one or more of the following attributes as a variable in optimization: a) data input (temperatures, steam date, etc.) from data collection system of the process, b) data base containing history from previous cleaning and results, and c) ECT measurements. According to the present invention, by combining desired values from the group of estimated variables 1-3 and variables a-c, optimization of the soot cleaning process can be made. An aim of the optimization process is to maximize the efficiency of the process, such as the combustion process, and to minimize the costs of the cleaning process. As a result from the optimization process, one achieves information which can be used to control the cleaning sequence, time between running of cleaning devices, or the like variables for the cleaning devices.

The present invention provides an improved control for the soot cleaning process. Based on the information achieved with the optimization according to the present invention, one can e.g. define individually for each separate cleaning device different time between running and running parameters during cleaning.

While the invention has been described in the context of a preferred embodiment, it will be apparent to those skilled in the art that the present invention may be modified in numerous ways and may assume many embodiments other than that specifically set out and described above. The air/fuel optimization method and the soot cleaning optimization method can be exploited independently and thus described methods are not dependent of each other. Furthermore, it should be noted, that the soot cleaning method according to the present invention can be carried out by using also other suitable measuring systems than ECT and which can detect changes in the gas stream during the soot cleaning. Such systems include e.g. optical measuring systems and other electrical measuring systems.

The invention claimed is:

1. A method of cleaning heat exchange surfaces of a heat exchange system, comprising the steps of:

(a) leading an exhaust gas stream by the heat exchange surfaces of a heat exchange system;

(b) performing a cleaning cycle on the heat exchange surfaces by cleaning sequentially differently located parts of the heat exchange surfaces with cleaning equipment having an operation parameter status, wherein respective particles are released sequentially from each of the differently located parts being cleaned, and the released respective particles associated with each of the differently located parts being cleaned are entrained sequentially with the exhaust gas stream;

(c) measuring the amount and/or type of the respective particles sequentially entrained with the exhaust gas stream so as to create particle measurement data associated with each of the respective differently located parts of the heat exchange surfaces cleaned during a cleaning cycle, and (d) linking together and storing into an electronic memory location information of the respective differently located parts of the heat exchange surfaces that are cleaned during the cleaning cycle and the respective particle measurement data created during the cleaning cycle so as to create fouling information related to fouling on the respective differently located parts of the heat exchange surfaces as a function of the location of the respective differently located parts of the heat exchange surfaces.

2. The method according to claim 1, further comprising the steps of storing the operation parameter status into the electronic memory, and linking the operation parameter status together with the location information of the respective parts of the heat exchange surfaces being cleaned during the cleaning cycle and the particle measurement data created during the cleaning of the respective parts of the heat exchange surfaces.

3. The method according to claim 2, wherein the operation parameter status comprises the status of at least one operation parameter selected from the group consisting of identification data of the cleaning equipment, location information of the cleaning equipment, operational status of the cleaning equipment, speed of the cleaning equipment, and effect of the cleaning equipment.

4. The method according to claim 1, wherein the cleaning equipment comprises a soot blower.

5. The method according to claim 1, wherein the cleaning equipment comprises at least one selected from the group consisting of a steam based soot blower, an acoustic soot blower, an air gun, a hammer cleaner, and a mechanical cleaner.

6. The method according to claim 1, wherein the measuring step (c) comprises measuring the mass flow of particles in the exhaust gas stream.

7. The method according to claim 1, further comprising the step of optimizing the time lapse between two cleanings of different parts of the heat exchange surfaces by using the fouling information as a function of the location of the heat exchange surfaces.

8. The method according to claim 1, further comprising the step of optimizing the cleaning speed of the cleaning equipment used for cleaning different parts of the heat exchange surfaces by using the fouling information as a function of the location of the heat exchange surfaces.

9. The method according to claim 1, further comprising optimizing the operation parameters for the cleaning of different parts of the heat exchange surfaces by using the fouling information as a function of the location of the heat exchange surfaces.

10. The method according to claim 7, 8 or 9, wherein optimizing is based on at least one variable of a tendency of fouling on different parts of the heat exchange surfaces, and a carbon content in the ash.

11. The method according to claim 1, further comprising using the fouling information as a function of the location of the heat exchange surfaces for estimating the tendency of fouling on the heat exchange surfaces.

12. The method according to claim 1, further comprising using the fouling information as a function of the location of the heat exchange surfaces for estimating the distribution of fouling on the heat exchange surfaces.

13. The method according to claim 1, further comprising the steps of:

measuring particle distribution on a cross-section of an exhaust gas channel, comparing the measured data of the particle distribution with previous measurements of the particle distribution, and using the result of the comparison in determining the distribution and tendency of fouling on the heat exchange surfaces.

14. The method according to claim 1, wherein measuring of the amount and/or type of the released particles in the exhaust gas stream is made with an Electric Charge Transfer measurement system.

15. The method according to claim 14, further comprising:

producing AC and DC signals representing particles in the exhaust gas stream by the Electric Charge Transfer measurement system, and determining the tendency and distribution of fouling on the heat exchange surfaces by using the AC and DC signals.

16. The method according to claim 14, further comprising estimating the amount of unburned carbon in the ash flow in the exhaust gas stream by using the AC and DC signals produced by the Electric Charge Transfer measurement system.

* * * * *